US006637604B1

(12) United States Patent
Jay

(10) Patent No.: US 6,637,604 B1
(45) Date of Patent: Oct. 28, 2003

(54) DISPENSING TRAY WITH DROP PRODUCT ROTATION

(75) Inventor: Richard Jay, Westport, CT (US)

(73) Assignee: Display Technologies, LLC, College Point, NY (US)

( * ) Notice: Subject to any disclaimer, the term of this patent is extended or adjusted under 35 U.S.C. 154(b) by 0 days.

(21) Appl. No.: 10/155,252

(22) Filed: May 23, 2002

(51) Int. Cl.[7] ..... A47F 7/00
(52) U.S. Cl. ..... 211/59.2; 211/74; 312/45
(58) Field of Search ..... 211/74, 59.2, 59.3; 312/45, 72

(56) References Cited

U.S. PATENT DOCUMENTS

| | | | | | |
|---|---|---|---|---|---|
| 1,004,998 | A | | 10/1911 | Crecelius | |
| 2,125,000 | A | | 7/1938 | Considine | |
| 2,289,751 | A | * | 7/1942 | Brenholt | 211/59.2 |
| 2,382,191 | A | * | 8/1945 | Weichselbaum | 312/45 |
| 2,408,380 | A | | 10/1946 | Dennis | |
| 2,852,327 | A | | 9/1958 | Mason | |
| 3,393,808 | A | * | 7/1968 | Chirchill | 211/59.2 |
| 3,501,016 | A | | 3/1970 | Eaton | |
| 3,606,022 | A | | 9/1971 | Beesley, Jr. | |
| 3,805,964 | A | * | 4/1974 | Titus | 211/59.2 |
| 4,228,903 | A | * | 10/1980 | Eckert | 211/59.2 |
| 4,287,992 | A | | 9/1981 | Takemori | |
| 4,386,710 | A | * | 6/1983 | Dauman | 211/59.2 |
| 4,435,026 | A | | 3/1984 | Johnson | |
| 4,744,489 | A | * | 5/1988 | Binder et al. | 211/59.2 X |
| 4,776,470 | A | * | 10/1988 | Chap | 211/59.2 |
| 4,785,943 | A | * | 11/1988 | Deffner et al. | 211/59.2 |
| 4,998,628 | A | | 3/1991 | Ross | |
| 5,314,078 | A | | 5/1994 | Morikiyo et al. | |
| 5,353,939 | A | * | 10/1994 | Beeler et al. | 211/59.3 |
| D363,174 | S | | 10/1995 | Fletcher, Sr. | |
| 5,586,665 | A | | 12/1996 | Brousseau | |
| 5,595,310 | A | | 1/1997 | Spamer et al. | |
| 5,865,324 | A | | 2/1999 | Jay et al. | |
| 5,878,862 | A | | 3/1999 | Dewsnap | |

* cited by examiner

*Primary Examiner*—Robert W. Gibson, Jr.
(74) *Attorney, Agent, or Firm*—Amster, Rothstein & Ebenstein

(57) ABSTRACT

A front loading and front-dispensing drop rotation tray for product display and dispensing include a pair of vertically aligned inclined tracks for supporting product thereon, the tracks generally being inclined in an orientation for fostering product movement relative thereto—namely, a first upwardly and rearwardly inclined loading/dispensing track, and a second upwardly and rearwardly inclined dispensing track beneath the first track. The first track defines a drop aperture adjacent the rear end thereof enabling the passage of product from the first track onto the second track, whereby successive forcible loading of product onto the front of the first track causes the product to pass, under the influence of gravity, to the second track for display and dispensing.

15 Claims, 5 Drawing Sheets

DISPENSING TRAY WITH DROP PRODUCT ROTATION

BACKGROUND OF THE INVENTION

The present invention relates to a product dispensing tray affording automatic product rotation, and more particularly to such a tray for use with product in an upright orientation.

Both wholesalers and retailers alike are aware of the need for product rotation to prevent "first in, last out" (FILO) dispensing of product, thereby to avoid product becoming stale—for example, expiration dates exceeded, carbonated beverages losing their fiz, product packaging becoming dirty or dull over time, etc. Milk, medicine, film and batteries are just a few of the many items now bearing expiration dates. The problem of product rotation is especially felt in retail establishments such as super markets, grocery stores and the like, where many relatively small items of a given product must be stored and displayed, often in a relatively confined space which does not lend itself to periodic manual rotation of the product. In any case, manual rotation of product, even where feasible, is labor-intensive and hence both expensive and time-consuming.

To avoid the need for manual rotation of product, various display and dispensing devices affording a virtual (non-manual) rotation of product have been developed. Such devices have not proven to be entirely satisfactory in use for one or more of a variety of reasons as follows:

(a) They must be used only for product capable of rolling along an inclined track—e.g., cylindrical product.

(b) They must be wide enough to accommodate two side-by-side tracks so that product loaded onto one track passes over to a laterally adjacent track for removal by a purchaser.

(c) They require loading of the product from the back of the tray, such back loading of product often being impossible or impractical.

(d) They are limited in capacity to the number of products which can be stored on a track extending from the front of the display to the back of the display.

(e) Where they are two tracks, dispensing (unloading) of the product by the consumer is available only at the front of one of the tracks.

Accordingly, the need remains for a front-loading and front-dispensing virtual rotation (as opposed to manual rotation) apparatus for product display and dispensing which comprises a pair of vertically aligned incline tracks for supporting product thereon, the tracks being inclined in an orientation for fostering sliding movement of upright product relative thereto.

It is an object of the present invention to provide front-loading and front-dispensing virtual rotation apparatus for product display and dispensing.

Another object is to provide such apparatus which, in one preferred embodiment, may be used for sliding product there along in an upright orientation.

Yet another object is to provide such apparatus which, in one preferred embodiment, need not be substantially wider than the product itself.

A further object is to provide such apparatus which, in one preferred embodiment, can store at least about twice the amount of product which could extend along a track from the front of the apparatus to the rear of the apparatus.

It is also an object of the present invention to provide such apparatus wherein, in one preferred embodiment, both the top and bottom tracks may be used for dispensing product.

It is another object to provide such an apparatus which, in one preferred embodiment, is simple and inexpensive to manufacture, use and maintain.

SUMMARY OF THE INVENTION

It has now been found that the above and related objects of the present invention are obtained in a front-loading and front-dispensing drop rotation apparatus for product display and dispensing. The apparatus comprises a pair of vertically aligned inclined tracks for supporting product thereon, the tracks generally being inclined in an orientation for fostering product movement relative thereto. The apparatus includes a first upwardly and rearwardly inclined loading/dispensing track, and a second upwardly and rearwardly inclined dispensing track beneath the first track. The first track defines a drop aperture adjacent the rear end thereof enabling the passage of product from the first track onto the second track, whereby successive forcible loading of product onto the front of the first track causes the product to pass, under the influence of gravity, to the second track for display and dispensing.

Preferably the apparatus is for the display and dispensing of slidable upright product, wherein the tracks support product thereon in an upright orientation, the tracks being inclined for fostering sliding movement of the upright product relative thereto.

In a preferred embodiment, the apparatus additionally includes a vertically serpentine even plurality of at least two vertically aligned inclined intermediate tracks connecting the first track and the second track. The intermediate tracks include a first upwardly and rearwardly inclined intermediate track beneath the first track, and a second downwardly and rearwardly inclined intermediate track beneath the first intermediate track and above the second track. Each of the intermediate tracks adjacent a lower end thereof defines a respective drop aperture enabling the passage of product from an upper intermediate track onto a next lower intermediate track or the second track, whereby successive forcible loading of product onto the front of the first track causes the product to pass, under the influence of gravity and via successively lower intermediate tracks, to the front of the second track.

Preferably each track comprises a laterally spaced pair of upstanding sidewalls and a floor connecting the sidewalls, the floor being wider than the product in an upright orientation and the sidewalls defining a space therebetween wider than the product in an upright orientation. The drop aperture is in the floor, the drop aperture of the first track being adjacent a rear end of the floor.

In another preferred embodiment at least one of the first and second tracks has adjacent the front end thereof means for slowing forward product movement at the front end thereof without terminating the forward movement, means for displaying the forward product thereon in a substantially upright orientation, or a generally horizontal section which slows forward product movement at the front end thereof without terminating the forward movement and displays the lead product thereon in a substantially upright orientation. Preferably each of the first and second tracks has one such horizontal section, the horizontal section being configured and dimensioned to substantially support only the lead product thereon.

BRIEF DESCRIPTION OF THE DRAWING

The above and related objects, features and advantages of the present invention will be fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
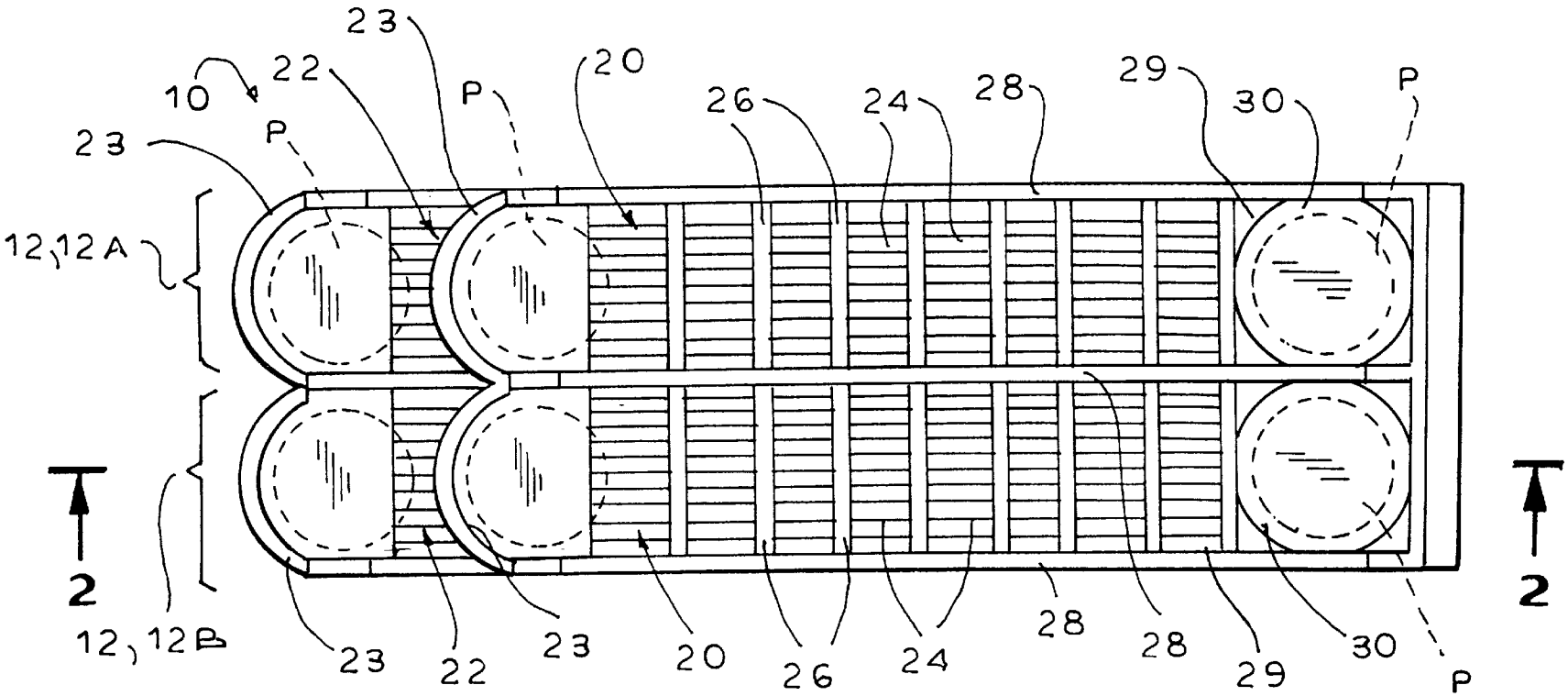
FIG. 1 is a top plan view of apparatus according to the present invention.
Figure 2:
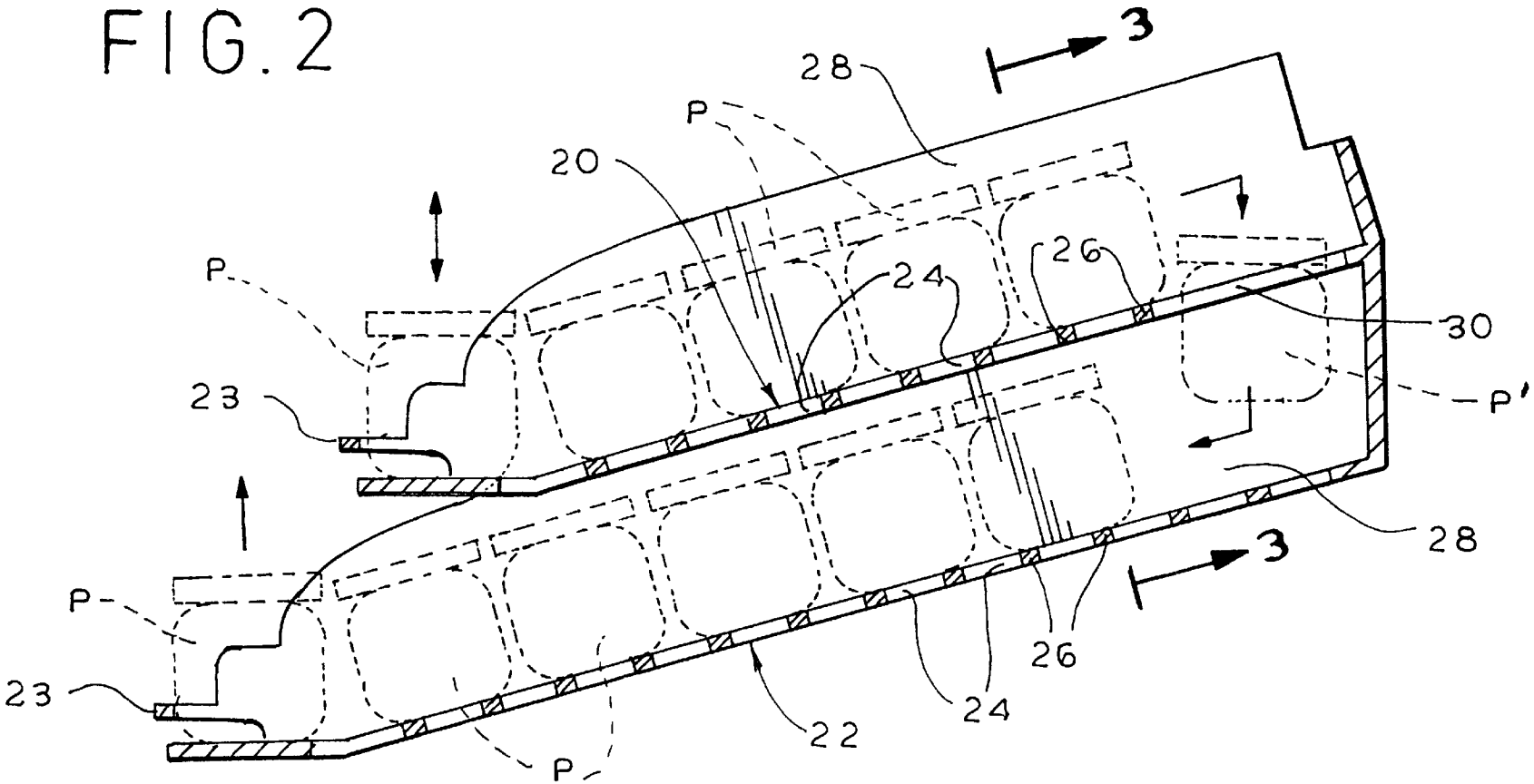
FIG. 2 is a sectional side elevational view thereof, taken along the line 2—2 of FIG. 1.
Figure 3:
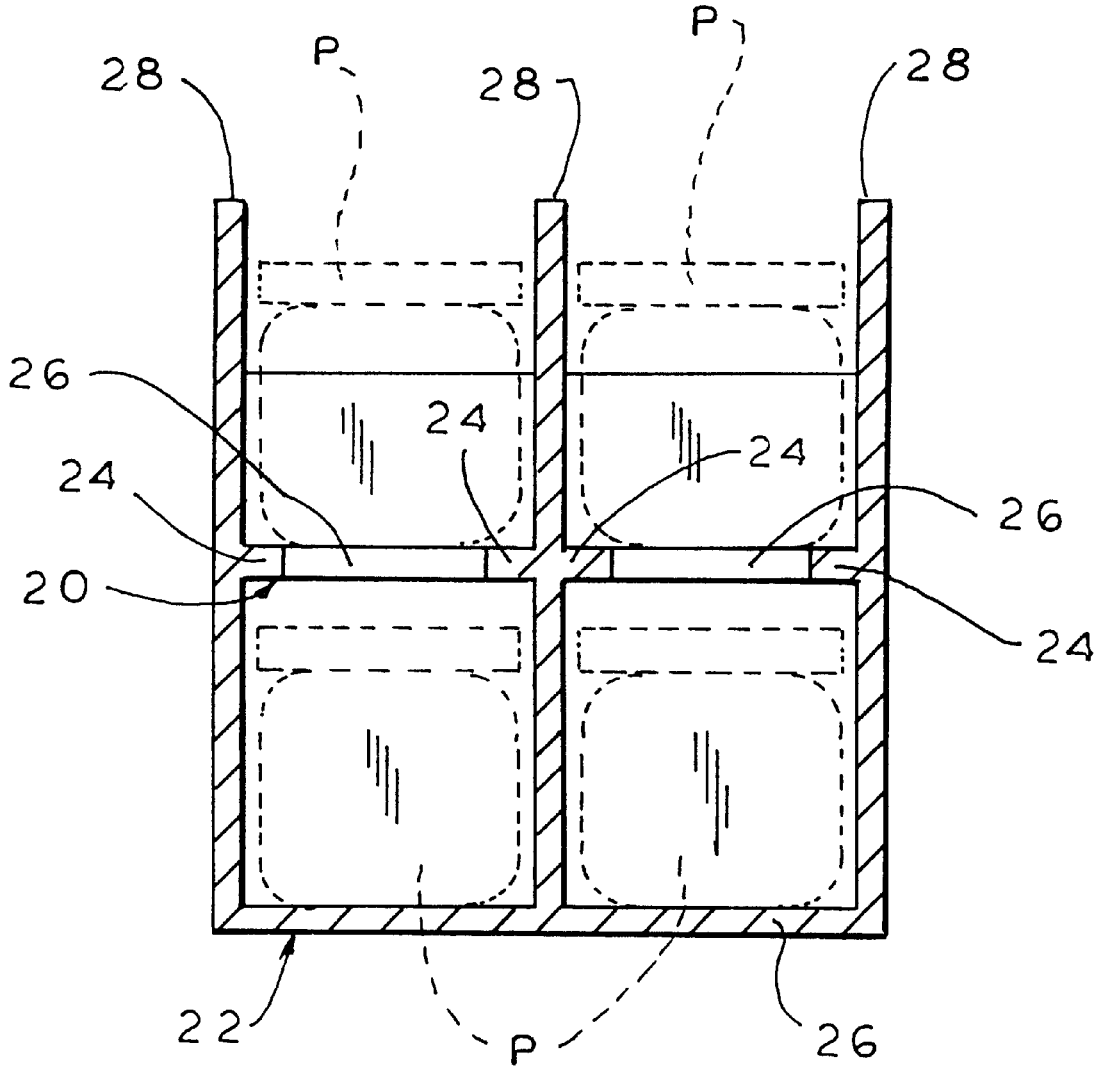
FIG. 3 is a sectional end elevational view thereof, taken along the line 3—3 of FIG. 2.

Referring now to the drawing, and in particular to FIGS. 1–3 thereof, therein illustrated is a front-loading and front-dispensing drop rotation unit according to the present invention, generally designated by the reference numeral 10. As illustrated and described herein the unit 10 is functionally formed of two apparatus generally designated 12, although a unit 10 could be formed any lesser or greater number of apparatus 12. Each apparatus 12A, 12B is one track wide and functionally independent of the other apparatus 12B, 12A, although both 12A and 12B are present in a single structurally integrated unit 10. The use of a unit 10 which is at least two tracks wide offers the advantage of increased lateral stability, but this is not deemed critical to the present invention.

In FIG. 1, the lead and rear product on the tracks is illustrated in broken line as a jar or small bottle P, although it will be appreciated that a wide variety of products may be displayed and dispensed from the apparatus 12, some taller and some shorter. Preferably, the apparatus 12 is designed for the display and dispensing of slidable product, with the tracks 20, 22 supporting the product thereon in an upright orientation and being inclined for fostering sliding movement of the upright product P relative thereto. However clearly the apparatus may also be used with rolling product.

As seen in FIG. 2, each apparatus 12A, 12B comprises a pair of vertically aligned inclined tracks, generally designated 20, 22, one being located above the other for supporting product P thereon. The tracks 20, 22 are generally inclined in an orientation for fostering product movement relative thereto, and in particular, sliding (or rolling) of the product P there along from the top of each track 20, 22 to the bottom thereof. Each apparatus 12A, 12B includes a first upwardly and rearwardly inclined loading/dispensing (loading/unloading) track 20 and a second upwardly and rearwardly inclined dispensing (unloading) track 22 beneath the first track 20. The first or top track 20 is shorter than the second or bottom track 22, with the second track 22 extending forwardly of the first track 20 (as illustrated in FIGS. 1 and 2), preferably by about the diameter or length of a product P, so that the front end of the first track 20 does not interfere with the removal by a customer of a lead product from the front of the second track 22. The front end of each track 20, 22 includes a conventional stop mechanism 23, such as that disclosed in commonly assigned U.S. Pat. No. 5,645,176, to stop forward motion of product thereon.

For the major portion of its length, each track 20, 22 is of conventional design. As illustrated, each track 20, 22 is formed of transversely spaced longitudinal members 24 (which are laterally spaced apart to reduce friction with the moving product and facilitate cooling airflow through the apparatus) and longitudinally spaced transverse members 26 (which extend across the track 20, 22 to rigidify and strengthen the longitudinal members 24). Each track 20, 22 comprises a laterally spaced pair of upstanding sidewalls 28 and a floor 29 (formed of members 24,26) connecting the sidewalls 28. Floor 29 is preferably wider than the product in an upright orientation, and sidewalls 28 preferably define a lateral space therebetween wider than the product in an upright orientation. The two sidewalls 28 intermediate apparatus 12A and 12B are preferably integrally formed as a single common sidewall, and the sidewalls of each first track 20 are preferably integrally formed with the sidewalls 28 of each vertically aligned second track 22 therebelow as single common sidewalls. The heights of sidewalls 28 (and in particular the vertical spacing between floors 29 of the first and second tracks 20, 22) limits the height of the product P to be used therewith.

The first track 20 defines a drop aperture 30 adjacent the rear end of floor 29 thereof to enable the passage of product P during the loading process, under the influence of gravity, from the rear of the first track 20 onto the rear of the second track 22. Drop aperture 30 is configured and dimensional to enable passage of individual products P therethrough, one at a time. There is no drop aperture in the floor 29 of the second track 22.

FIG. 2 illustrates a rearmost product unit P' in the process of falling through the drop aperture 30 from the rear of first track 20 (where it has been pushed by successive front loading of product P onto the first track 20) downwardly onto the rear of second track 22, after which it moves forwardly along the second track 22 until stopped by the rearmost product on second track 22.

Figure 4:
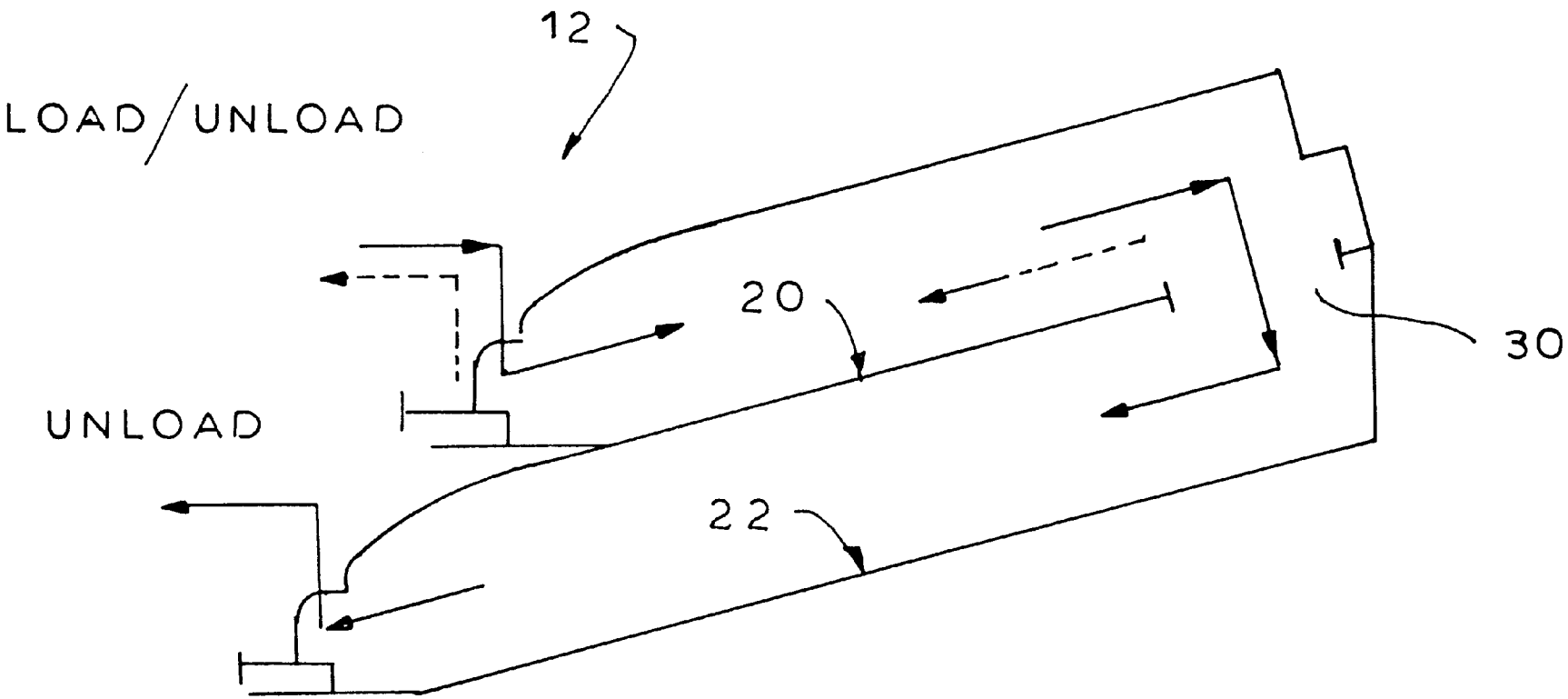
FIG. 4 is a schematic view illustrating operation of the apparatus during the loading and dispensing (unloading) operations.

Referring now to FIG. 4, therein illustrated by the solid line arrows is the operation by which successive front loading of product P onto the front of the first track 20 causes the product P to pass, under the influence of gravity, through the drop aperture 30 at the rear of the first track 20. The product then drops onto the rear of the second track 22 and moves forwardly, under the influence of gravity, towards the front of the second track 22 (until stopped by any product already on the second track 22) for display and dispensing (unloading) from the second track 22. The broken line arrows illustrated in FIG. 4 in connection with the first track 20 are similar to the solid line arrows associated with the second track 22 and illustrate the optional dispensing (unloading) of product from the front of the first track 20.

While product may be dispensed from the front of either track 20, 22, loading is performed only from the front of first track 20. Second track 22 is "virtually" loaded from the rear, via drop aperture 30, during front loading of first track 20.

In order to achieve perfect virtual rotation, dispensing (unloading) of product should be enabled only from the front of second track 22, and not from the front of first track 20 as well. However, for those products which do not require a strict "first in, first out" (FIFO) rotation, adequate virtual rotation of product is achieved when dispensing is possible from both tracks 20, 22 so long as there is at least some minimal dispensing (unloading) from second track 22 over time.

Figure 5:
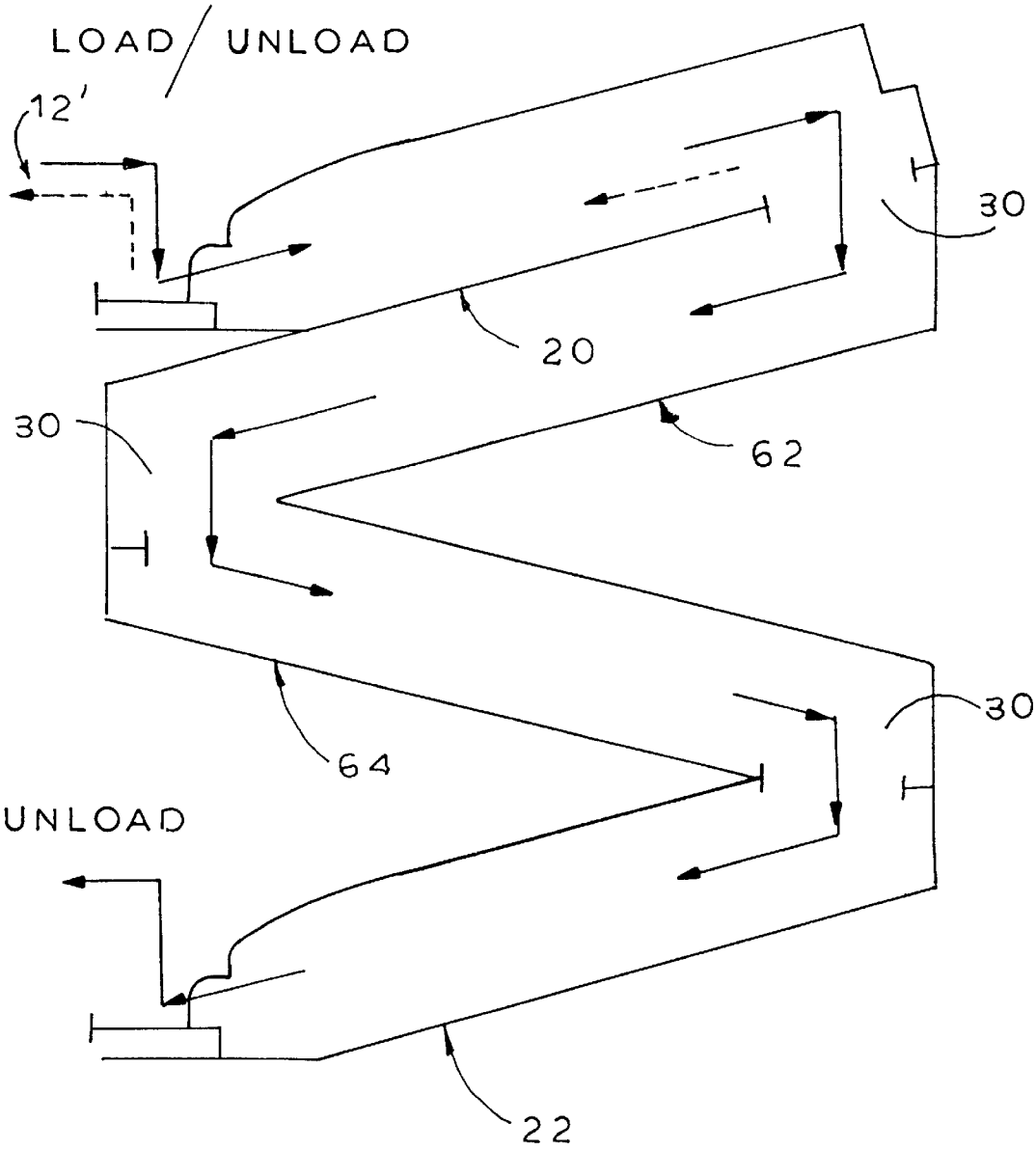
FIG. 5 is a schematic view similar to FIG. 4 for a variant of the present invention utilizing four tracks instead of two.

Referring now to FIG. 5 in particular, therein illustrated is a variant, generally designated 12', of the apparatus 12 illustrated in FIGS. 1 through 4. The variant 12' is suitable for use in areas where there is a substantial amount of shelf or counter height available and offers the advantage that less frequent loading (refilling) of the tracks with product is required since the apparatus 12' carries at least about twice as much product as the apparatus 12. The apparatus 12' is similar to the apparatus 12, but, in addition to a pair of vertically aligned tracks 20, 22, includes a vertically serpentine even plurality of at least two intermediate tracks connecting the first track 20 and the second track 22. The intermediate tracks include a first upwardly and rearwardly inclined intermediate track, generally designated 62, immediately beneath the first track 20 and a second downwardly and rearwardly inclined intermediate track, generally designated 64, beneath (but not necessarily immediately beneath) the first intermediate track 62 and immediately above the second track 22. Each of the intermediate tracks 62, 64 adjacent a lower end thereof—whether it be the front end (as for first intermediate track 62) or rear end (as for second intermediate track 64) thereof—defines a respective drop aperture 30 enabling the passage of product from an upper intermediate track (e.g., intermediate track 62) onto a next lower intermediate track (e.g., intermediate track 64) or the second track 22. Thus, successive loading of product onto the front of the first track 20 causes the product to pass, under the influence of gravity and via successively lower intermediate tracks 62, 64 to the front of the second track 22.

By an "even plurality of at least two intermediate tracks" connecting the first and second tracks is meant 2, 4, 6, etc. intermediate tracks starting with a first intermediate track 62 and ending with a second intermediate track 64.

Comparing FIGS. 4 and 5, it will be appreciated that the product P dropping through the drop aperture 30 of the two track apparatus 12 of FIG. 4 lands on the second track 22 at the same angle as it left the first track 20. Accordingly, the product tends to remain relatively stable, without tilting or falling over as it begins to travel along second track 22. By way of contrast, in the four track apparatus 12' of FIG. 5, product P passing through the second drop aperture 30 (between first intermediate track 62 and second intermediate track 64) and through the third drop aperture 30 (between second intermediate track 64 and second track 22) lands on less than the full bottom thereof, so that there is more of a tendency for the product P to tip over as it begins its travel down the second intermediate track 64 or second track 22, respectively. Any tendency of a product P to tip over may kept under control either through the use of only products having a low center of gravity or by the deployment of resilient catcher elements (not shown) which extend into the travel path of the product P (after its passage through the drop aperture 30) at a height above the center of gravity of the product P to assert a counterbalancing force on the product P before being swept out of the travel path.

Each of the first and second tracks 20, 22 may define a constant incline (relative to the horizontal) throughout its length. However, preferably each track front end 25, for about the diameter or length of a unit of product P, defines a substantially horizontal section 25. This unique construction of the tracks 20, 22 affords a variety of advantages.

First, the horizontal section 25 acts to slow the travel of product P as it transitions from a gravity-impelled travel down the major inclined portion of the track 20, 22 to an inertia-impelled travel along the minor horizontal section 25. This is of minor significance with regard to the first track 20, where the travel of product towards the front of the first track 20 typically occurs only after a lead product unit has been removed from the front thereof, so that the new lead product has only a short distance in which to build up any inertia or momentum before it is restrained by the stop mechanism 23. On the other hand, this is of significant import with regard to the second track 22 where, during loading of product onto an empty apparatus 12, the first unit of product P, after falling through the last drop aperture 30, may have the entire length of the major inclined portion of the second track 22 in which to build up inertia or momentum before it is restrained by the stop mechanism 23. This can place an undue strain on the stop mechanism 23 for the second track 22 and, even if stop mechanism 23 itself is undamaged thereby, the shock of the rapidly moving product unit against the stop mechanism 23 may result in an undesirable vibration or shaking of the apparatus 12.

Second, regardless of whether the "slow-down" feature of the horizontal section 25 is desirable or necessary, the horizontal section 25 serves the additional purpose of presenting the lead product on each track 20, 22 to the potential customer in a horizontal disposition where the label, advertising and the like on the product unit may be easily viewed. By way of contrast, where the inclination of the track 20, 22 is uniform throughout its length, the lead product unit at the front of each track 20, 22 is presented on an angle to the horizontal such that the label, advertising and the like faces at least partially downwardly, so that it cannot be easily read.

To summarize, the present invention provides front-loading and front-dispensing virtual rotation apparatus for product display and dispensing, the apparatus being useful for sliding product in an upright orientation as well as rolling product. The apparatus need not be substantially wider than the product itself, and yet can store at least about twice the amount of product which could extend along a track from the front of the apparatus to the rear of the apparatus. Both the top and bottom tracks may be used for front-dispensing (unloading) of product. The apparatus is simple and inexpensive to manufacture, use and maintain.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing specification.

I claim:

1. A front-loading and front-dispensing drop rotation apparatus for product display and dispensing, comprising a pair of vertically aligned inclined tracks for supporting product thereon, said tracks generally being inclined in an orientation for fostering product movement relative thereto, including:

(A) a first upwardly and rearwardly inclined loading/dispensing track at the top, and (B) a second upwardly and rearwardly inclined dispensing track beneath said first track at the bottom;

said first track defining a drop aperture adjacent the rear end thereof enabling the passage of product from said first track onto said second track;

whereby successive forcible loading of product onto the front of said first track causes the product to pass, under the influence of gravity, to said second track for display and dispensing.

2. A front-loading and front-dispensing drop rotation apparatus for display and dispensing of slidable upright product, comprising a pair of vertically aligned inclined tracks for supporting product thereon in an upright orientation, said tracks being inclined for fostering sliding movement of the upright product relative thereto, including:

(A) a first upwardly and rearwardly inclined loading/dispensing track, and (B) a second upwardly and rearwardly inclined dispensing track beneath said first track;

said first track defining a drop aperture adjacent the rear end thereof enabling the passage of product from said first track onto said second track;

whereby successive forcible loading of product onto the front of said first track causes the product to pass, under the influence of gravity, to said second track for display and dispensing.

3. A front-loading and front-dispensing drop rotation apparatus for product display and dispensing, comprising a pair of vertically aligned inclined tracks for supporting product thereon, said tracks generally being inclined in an orientation for fostering product movement relative thereto, including:

(A) a first upwardly and rearwardly inclined loading/dispensing track;

(B) a second upwardly and rearwardly inclined dispensing track beneath said first track; and (C) a vertically serpentine even plurality of at least two vertically aligned inclined intermediate tracks connecting said first track and said second track, said intermediate tracks including:

(i) a first upwardly and rearwardly inclined intermediate track beneath said first track; and (ii) a second downwardly and rearwardly inclined intermediate track beneath said first intermediate track and above said second track;

each of said intermediate tracks adjacent a lower end thereof defining a respective drop aperture enabling the passage of product from an upper intermediate track onto a next lower intermediate track or said second track;

whereby successive forcible loading of product onto the front of said first track causes the product to pass, under the influence of gravity and via successively lower intermediate tracks, to the front of said second track.

4. The apparatus of claim 1 wherein each said track comprises a laterally spaced pair of upstanding sidewalls and a floor connecting said sidewalls.

5. The apparatus of claim 4 wherein said floor is wider than said product in an upright orientation, and said sidewalls define a space therebetween wider than said product in an upright orientation.

6. The apparatus of claim 4 wherein said drop aperture is in said floor.

7. The apparatus of claim 4 wherein said drop aperture of said first track is adjacent a rear end of said floor thereof.

8. The apparatus of claim 1 wherein at least one of said first and second tracks has adjacent the front end thereof means for slowing forward product movement at the front end thereof without terminating the forward movement.

9. The apparatus of claim 1 wherein at least one of said first and second tracks has adjacent the front end thereof means for displaying the forward product thereon in a substantially upright orientation.

10. A front-loading arid front-dispensing drop rotation apparatus for product display and dispensing, comprising a pair of vertically aligned inclined tracks for supporting product thereon, said tracks generally being inclined in an orientation for fostering product movement relative thereto, including:

(A) a first upwardly and rearwardly inclined loading/dispensing track, and (B) a second upwardly and rearwardly inclined dispensing track beneath said first track;

said first track defining a drop aperture adjacent the rear end thereof enabling the passage of product from said first track onto said second track;

whereby successive forcible loading of product onto the front of said first track causes the product to pass, under the influence of gravity, to said second track for display and dispensing at least one of said first and second tracks having adjacent the front end thereof a generally horizontal section which slows forward product movement at the front end thereof without terminating the forward movement and displays the forward product thereon in a substantially upright orientation.

11. The apparatus of claim 10 wherein each of said first and second tracks has one said horizontal section.

12. The apparatus of claim 10 wherein said horizontal section is configured and dimensioned to substantially support only the lead product thereon.

13. A front-loading and front-dispensing drop rotation apparatus for slidable upright product display and dispensing, comprising a pair of vertically aligned inclined tracks for supporting product thereon in an upright orientation, said tracks generally being inclined in an orientation for fostering sliding movement of the upright product relative thereto, including:

(A) a first upwardly and rearwardly inclined loading/dispensing track, and (B) a second upwardly and rearwardly inclined dispensing track beneath said first track;

each said track comprising a laterally spaced pair of upstanding sidewalls and a floor connecting said sidewalls, said floor being wider than the product in an upright orientation, and said sidewalls define a space therebetween wider than the product in an upright orientation;

said first track defining a drop aperture in said floor thereof adjacent the rear end thereof enabling the passage of product from said first track onto said second track;

whereby successive forcible loading of product onto the front of said first track causes the product to pass, under the influence of gravity, to said second track for display and dispensing.

14. The apparatus of claim 13 additionally including:

(A) a vertically serpentine even plurality of at least two vertically aligned inclined intermediate tracks connecting said first track and said second track, said intermediate tracks including:

(i) a first upwardly and rearwardly inclined intermediate track beneath said first track; and (ii) a second downwardly and rearwardly inclined intermediate track beneath said first intermediate track and above said second track;

each of said intermediate tracks adjacent a lower end thereof defining a respective drop aperture enabling the passage of product from an upper intermediate track onto a next lower intermediate track or said second track;

whereby successive forcible loading of product onto the front of said first track causes the product to pass, under the influence of gravity and via successively lower intermediate tracks, to the front of said second track.

15. The apparatus of claim 13 wherein at least one of said first and second tracks has adjacent the front end thereof at least one of means for slowing forward product movement at the front end thereof without terminating the forward product movement, means for displaying the forward product thereon in a substantially upright orientation, and a generally horizontal section which slows forward product movement at the front end thereof without terminating the forward movement and displays the forward product thereon in a substantially upright orientation.

* * * * *